US005163725A

United States Patent [19]

Leweallyn

[11] Patent Number: 5,163,725

[45] Date of Patent: Nov. 17, 1992

[54] EXPANDABLE CARPET ROLL PLUG

[76] Inventor: Michael A. Leweallyn, P.O. Box 1361, Dalton, Ga. 30720

[21] Appl. No.: 850,470

[22] Filed: Mar. 11, 1992

[51] Int. Cl.[5] ..... B66C 1/42

[52] U.S. Cl. ..... 294/1.1; 294/93

[58] Field of Search ..... 294/1.1, 67.1, 93; 414/910, 911, 683; 242/68, 68.4, 68.5, 68.6

[56] References Cited

U.S. PATENT DOCUMENTS

| | | | |
|---|---|---|---|
| 572,365 | 12/1896 | McCorkindale | 242/68 |
| 1,377,154 | 5/1921 | Flynn | 242/68 |
| 1,693,876 | 12/1928 | Unruh, Jr. | 242/68.4 |
| 4,154,470 | 5/1979 | Dalglish | 294/93 |
| 4,279,567 | 7/1981 | Thompson | 414/910 X |
| 4,687,244 | 8/1987 | Cullen et al. | 294/93 X |
| 4,799,721 | 1/1989 | Hale | 294/1.1 |

*Primary Examiner*—Margaret A. Focarino
*Assistant Examiner*—Dean J. Kramer
*Attorney, Agent, or Firm*—Hopkins & Thomas

[57] ABSTRACT

The hollow plug 6 is placed in the end opening of the inner tube 2 of a spirally wound package of sheet material, such as carpet. The hollow plug has a cylindrical section 10 and a conical section 11. The conical section includes approximately equal spaced elongated weakened areas or grooves 25 that spread apart in response to outwardly directed forces applied to the conical section from within the conical section. Ribs 18 extending along the outer surface of the cylindrical section tend to reduce the frictional contact between the plug and the inner tube 2 and the edge portion of the wrapping paper 4, while teeth 20 resist inadvertent withdrawal of the plug from the carpet package.

4 Claims, 3 Drawing Sheets

EXPANDABLE CARPET ROLL PLUG

FIELD OF THE INVENTION

The invention relates to an open-ended plug for insertion into the central opening of the inner tube of a reel of sheet material, such as a length of tufted carpet spirally wound about the inner tube.

BACKGROUND OF THE INVENTION

In the storage and transporting of lengths of carpet and possibly other sheet materials, it is customary to spirally wind the carpet about an elongated hollow cardboard tube so that the carpet is not folded and creased during storage and transportation. In some instances, wrapping paper is wound about the outer surface of the reel of carpet with the edges of the paper extending beyond and folded about the ends of the carpet reel and stuffed into the central opening formed by the inner cardboard tube. A hollow plug is thrust into the ends of the hollow tube, and the plug tends to hold the folded edges of the wrapping paper in place about the ends of the reel of carpet.

A lift truck having a horizontally disposed, elongated lift pole is used to move the carpet package from place to place. The lift truck is driven toward one end of the carpet package, and the lift pole is thrust into the opening of the hollow plug and on into the internal passage of the inner tube. The lift truck pole is raised by the lift truck, which causes the carpet package to be lifted from the floor, and then the lift truck is driven to another location where the carpet package is deposited by lowering the lift pole until the carpet package rests on the floor, etc., whereupon the lift truck and its pole are backed away from the carpet package.

While the foregoing procedure has been standard in the prior art, there are times when it is difficult to thrust the hollow, open-ended plug into the opening formed by the inner tube. The difficulty usually is caused by the wrapping paper being stuffed into the opening, which occupies some of the space of the opening, thereby narrowing the dimensions of the opening. The hollow plug being inserted into the end of the inner tube must receive the lift pole of the lift truck, and therefore its internal diameter must be of at least a minimum size to allow passage of the lift pole. As a result of the minimum dimensions of the passage of the hollow plug, the internal dimensions of the hollow plug are necessarily large and cannot be reduced to facilitate ease of insertion of the hollow plug into the end opening of the inner tube of the carpet package.

Thus, it can be seen that it would be desirable to provide a carpet roll plug that is tapered at one end to facilitate the insertion of the plug into the end of the inner tube of the carpet package, yet having the smaller end of the carpet roll plug not impede the passage therethrough of the lift pole of the lift truck as the pole is thrust into or withdrawn from the carpet roll plug.

SUMMARY OF THE INVENTION

Briefly described, the present invention comprises an expandable carpet roll plug for insertion into the openings formed at the ends of a package of sheet material, such as tufted carpet, which has been spirally wound about a cylindrical, elongated inner tube. The carpet roll plug comprises at one end a cylindrical section and at the other end a conical section. The conical section is tapered to a relatively small diameter at one end of the plug so that the small end of the conical section can be easily thrust into the central opening of the carpet package. The tapered external surface of the conical section of the carpet plug guides the wrapping paper or any other impediments outwardly as the plug is thrust into the inner tube.

The cylindrical section of the plug includes a plurality of substantially equally spaced elongated ribs which provide surfaces about the carpet roll plug for sliding frictional engagement with the facing materials of the inner tube and wrapping paper, thereby tending to reduce the friction applied to the moving plug. In addition, sloped teeth are formed on the cylindrical section of the hollow plug, with the teeth being sloped away from the conical section of the plug so as to allow the plug to be inserted into the opening of the inner tube of the carpet package, but to resist withdrawal of the plug from the inner tube of the carpet package.

Further, the conical section of the plug includes elongated areas of reduced thickness and of reduced strength which will allow the conical section to rupture into a plurality of spaced fingers. When the lift pole of the lift truck is thrust through the hollow plug, the lift pole easily fits within the breadth of the cylindrical section of the hollow plug, but as the lift pole begins to move through the conical section of the plug, the progressively smaller breadth of the conical section does not leave enough space for the passage therethrough of the lift pole. As a result, the lift pole applies outwardly directed forces to the reduced diameter portion of the conical section, and these forces tend to rupture and split the areas of reduced thickness of the conical section, permitting the conical section to become a series of separated fingers that can be expanded away from one another and form more space for the passage therebetween of the lift pole.

Thus, it is an object of the present invention to provide an expandable carpet roll plug that has one end of reduced outer dimensions that can seek and be thrust into an opening at the end of a spirally wound reel of sheet material, such as tufted carpet, yet when a lift truck pole is thrust into the plug, the areas of reduced dimensions of the plug are expandable so as to permit the passage therethrough of the lift pole.

Another object of this invention is to provide an expandable carpet roll plug that can be easily inserted into the end openings of a spirally wound reel of sheet material, such as tufted carpet, yet does not impede the passage therethrough of a lift truck pole.

Another object of this invention is to provide an improved plug for use in spirally wound reels of sheet material, such as carpet, which is inexpensive to produce, of simple design, which can be expediently used.

Other objects, features and advantages of the present invention will become apparent upon reading the following specification, when taken in conjunction with the accompanying drawings.

DETAILED DESCRIPTION

Figure 1:
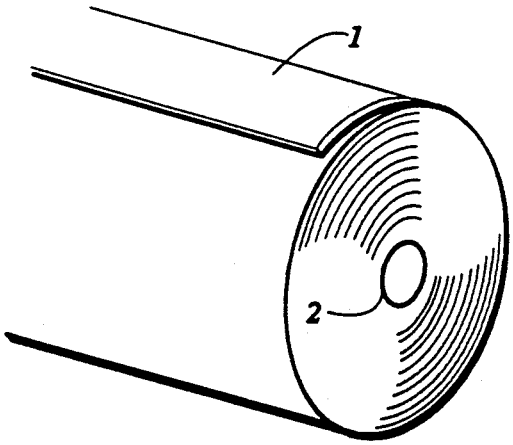
FIGS. 1-3 are perspective end views of a reel of carpet spirally wound about a centrally positioned inner cardboard tube, showing respectively, the reel of carpet before it has been wrapped, the wrapping paper as it is initially applied to the reel of carpet, and the folding of the protruding edges of the wrapping paper about the end portion of the reel of carpet and the insertion of the plug into the central opening of the package.

Referring now in more detail to the drawings, in which like numerals indicate like parts throughout the several views, FIG. 1 illustrates a reel 1 of spirally wound sheet material, such as carpet, with the carpet having been wound about an elongated cylindrical inner tube 2. Typically, the end of the inner tube protrudes from the end surface of the carpet package.

Figure 2:
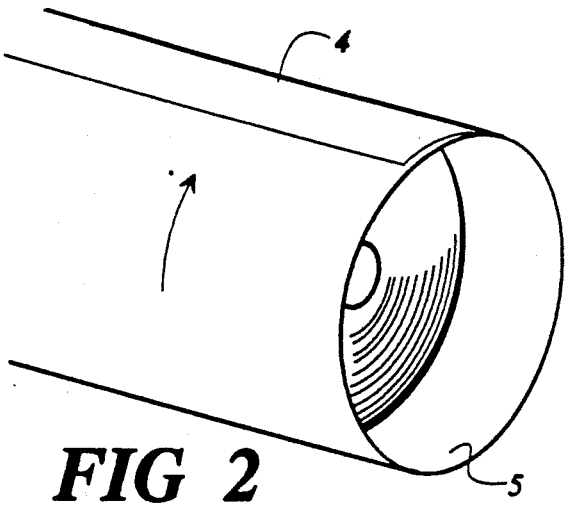
Figure 3:
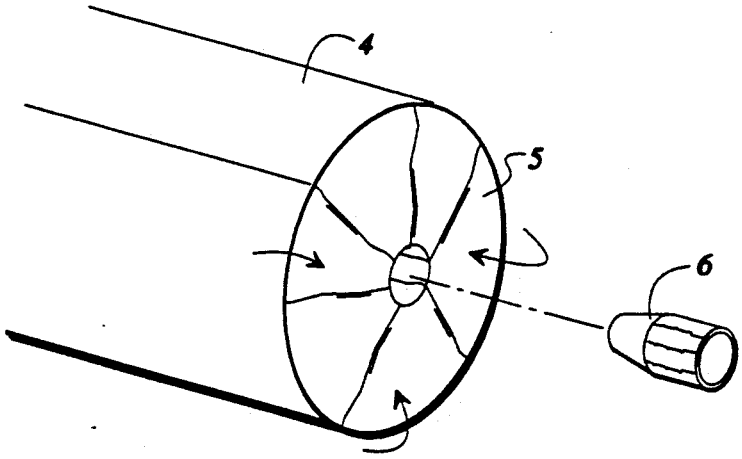

As illustrated in FIG. 2, wrapping paper or other sheet material 4 is wound about the carpet package, with the opposite edges 5 of the sheet material overhanging the ends of the carpet package. As shown in FIG. 3, the overhanging ends 5 of the wrapping paper are folded about the ends of the carpet package, and stuffed into the opening of the inner tube. Plug 6 is then inserted into the opening, so as to trap the edges of the wrapping material inside the inner tube, thereby closing and substantially sealing the wrapping sheet material about the carpet.

Figure 4:
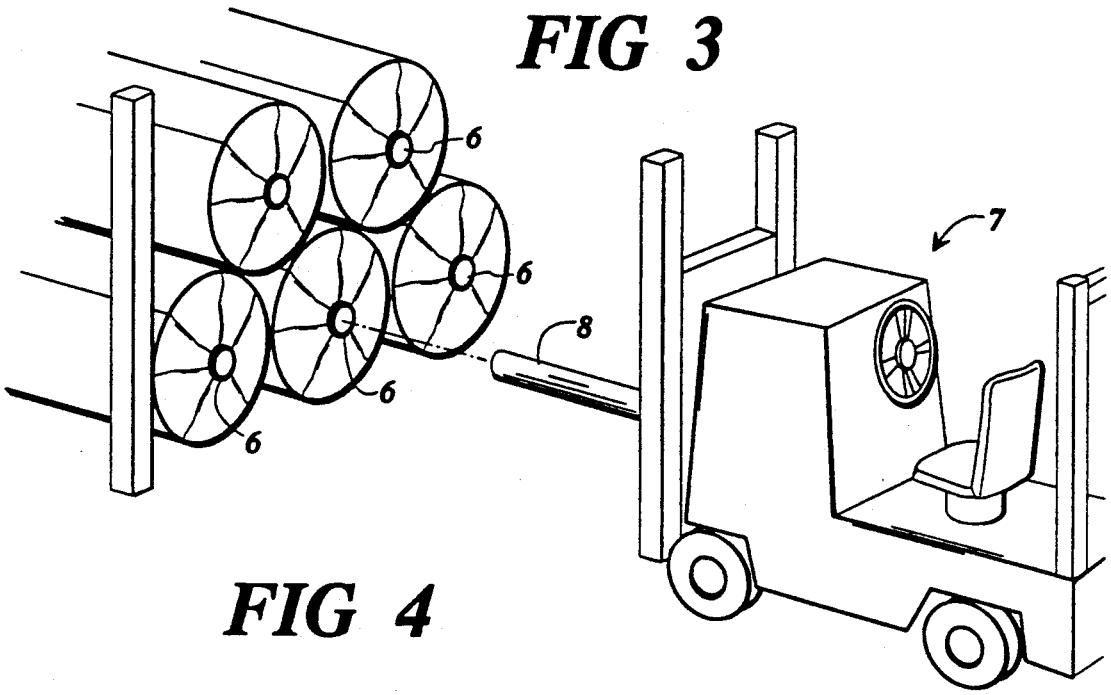
FIG. 4 is a perspective illustration of a plurality of stacked packages of carpet, and a lift truck of the type having a lift pole which is used to lift and transport the carpet packages.

As illustrated in FIG. 4, a lift truck 7 is used to transport the carpet packages. The lift truck 7 includes a lift pole 8 that is maintained in an approximately horizontal attitude. The pole is aimed by the driver of the lift truck toward the central opening formed by the hollow plug 6, and as the lift truck approaches the carpet package, the lift pole is thrust through the hollow plug 6 and on into the inner tube 2. Once the lift pole has been thrust into the hollow inner tube 2, the lift truck elevates the lift pole, which results in lifting the carpet package from the floor or other supporting surface. The lift truck can then be driven to another location to deposit the carpet package on the floor or other surface, and the lift truck backed away from the carpet package, thereby withdrawing the lift pole from the inner tube and hollow plug of the carpet package.

Figure 5:
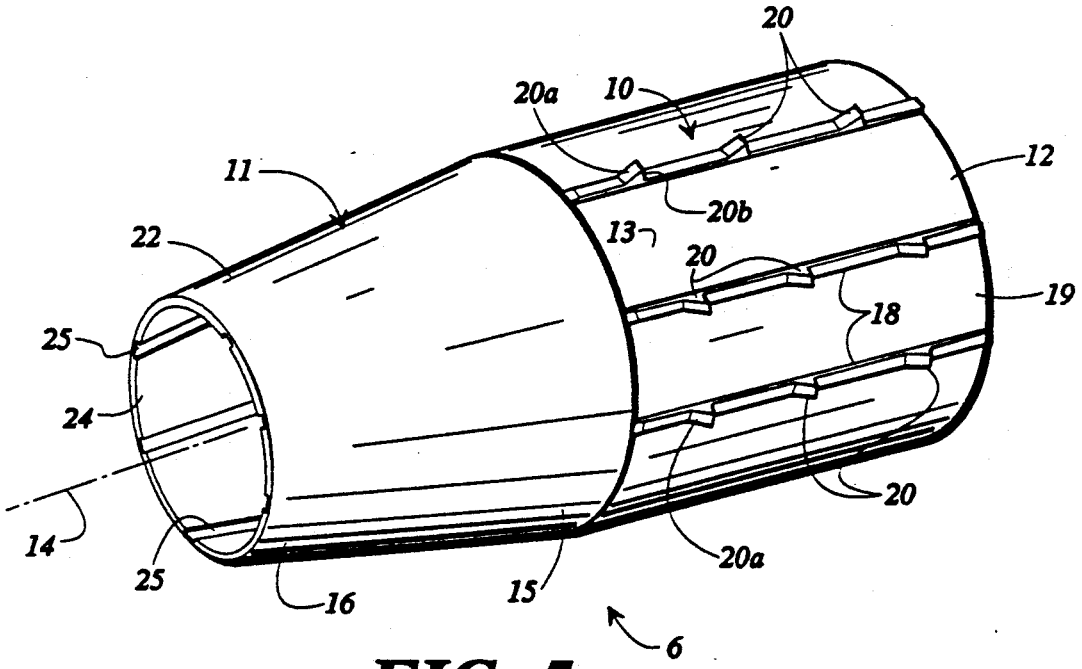
FIG. 5 is a perspective illustration of the carpet roll plug.
Figure 6:
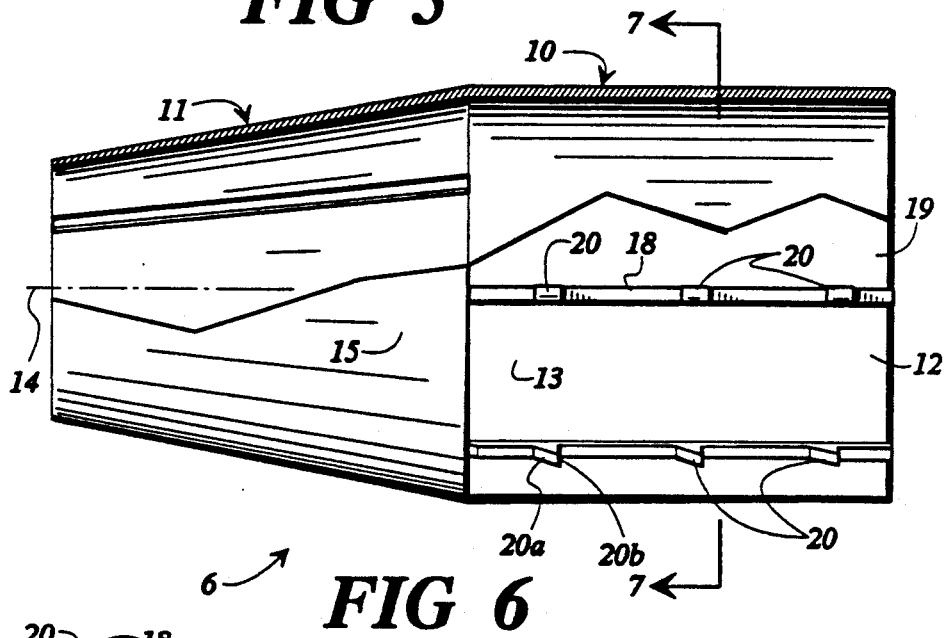
FIG. 6 is a side view, partially in cross section, of the carpet roll plug.
Figure 7:
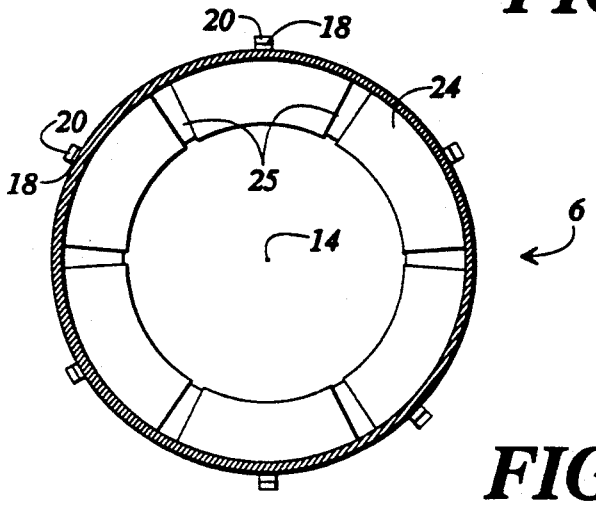
FIG. 7 is an end cross sectional view of the carpet roll plug, taken along lines 7—7 of FIG. 6.

As illustrated in FIG. 5, the carpet roll plug 6 comprises a cylindrical section 10 and a conical section 11. The cylindrical section 10 includes an outer end 12 and an inner end 13, while conical section 11 includes a larger diameter inner end 15 and a smaller diameter outer end 16. The inner end 13 of the cylindrical section and the inner end 15 of the conical section are of the same diameter and are integrally connected together, as shown.

A plurality of approximately equally spaced elongated parallel external ribs 18 are formed on the outer surface 19 of the cylindrical section 10. A plurality of teeth 20 are formed on each of the external ribs, with each of the teeth being sloped toward the outer end 12 of the cylindrical section. The angle of slope of the teeth 20 tends to permit the hollow plug 6 to be thrust into the end of the inner tube 2, with the sloped surfaces 20*a* offering little resistance to the wrapping paper and the facing surfaces of the inner tube 2. Since the wrapping paper 4 is flexible, and since the inner tube 2 is usually formed of cardboard, these materials usually will deflect out of the way of the oncoming teeth 20 as the plug 6 is thrust into the end of the inner tube 2. However, the other surface 20*b* of each tooth 20 is formed at approximately a right angle with respect to the longitudinal centerline 14 of the plug, and offers substantially more resistance against movement of the plug in the direction of withdrawal of the plug from the inner tube 2. This generally causes the plug to become locked in place within the end of the inner cardboard tube 2, so as to hold the edge portion 5 of the wrapping paper 4 in place and firmly and neatly form the end of the carpet package.

Conical section 11 includes a substantially smooth external surface 22, and an internal surface 24. A series of approximately equally spaced elongated weakened areas or grooves 25 are formed along the length of the conical section 11, extending inwardly from the internal surface 24 into the material of the conical section. These grooves 25 intersect the outer end 16 of the conical section 11 and extend to the inner end 15 of the conical section. In the event that outwardly directed forces are applied to the conical section within the conical section, the grooves 25, being of lesser thickness and therefore of lesser strength than the remaining portion of the conical section 11, tend to rupture so that the areas of the conical section 11 between the grooves 25 form a plurality of spread apart fingers.

Figure 8:
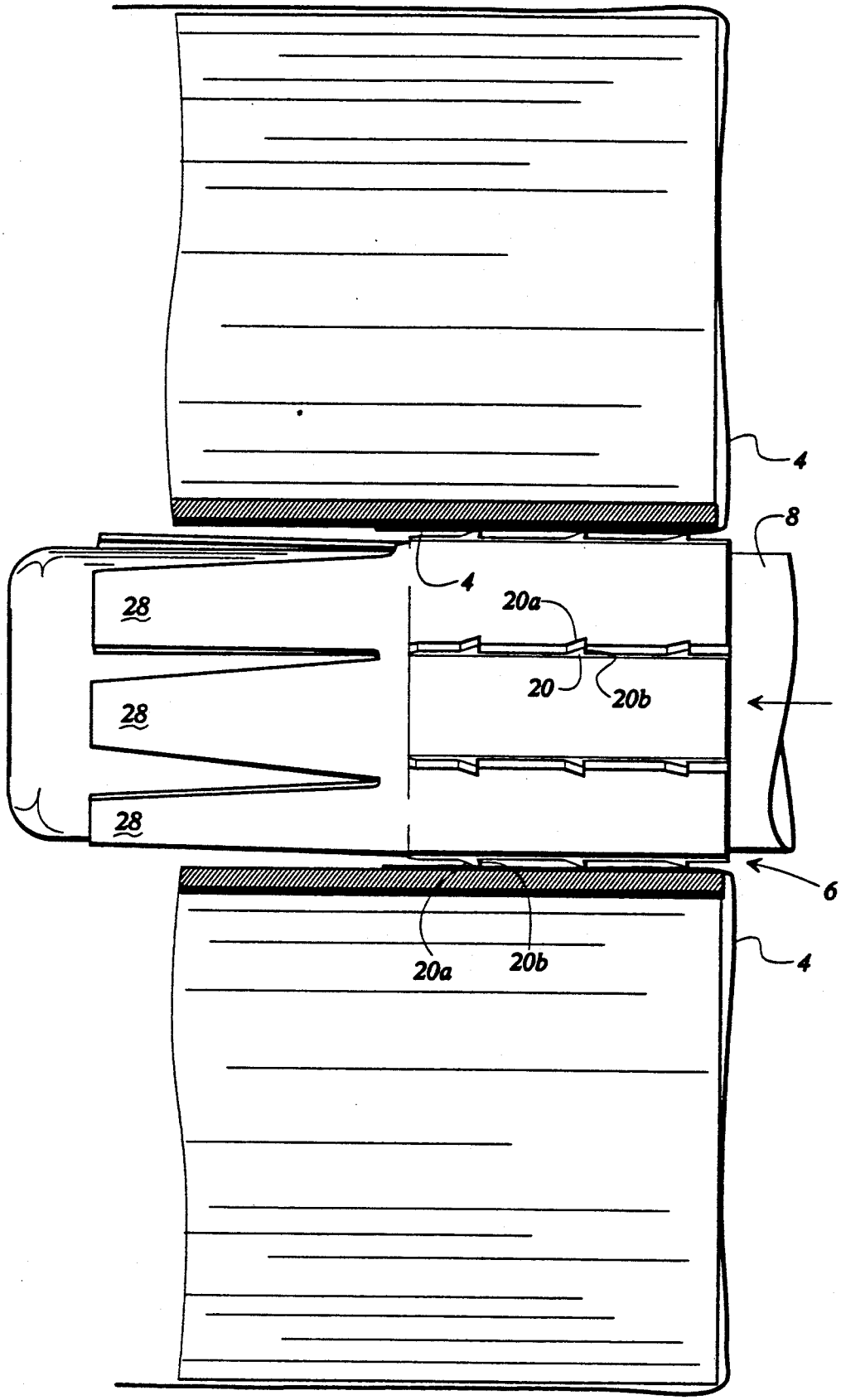
FIG. 8 is a side view of the expandable carpet roll plug after its conical section has been expanded and formed into a plurality of fingers, showing the lift pole as it is thrust through the plug, and showing the inner tube, wound carpet and wrapping paper in cross section.

For example, FIG. 8 illustrates the movement of the lift pole 8 as it is thrust by the lift truck 7 through the hollow plug 6. Since the outside diameter of the lift pole 8 is only slightly smaller than the inside diameter of the cylindrical section 10, when the end of the lift pole reaches the conical section 11, there is not enough space to accommodate further movement of the lift pole. Therefore, further movement of the lift pole 8 through the hollow plug 6 applies approximately equal outwardly directed wedging forces against the inner surface 24 of the conical section, and the conical section splits longitudinally along the grooves 25, forming the plurality of spread apart fingers 28. The spreading apart of the fingers 28 permits the lift pole to move on through the hollow plug 6.

An important feature of the invention is that the conical section 11 of the plug 6 is of converging, reduced diameter toward its outer end 16. This permits the plug to be easily inserted into the inner tube 2 of the carpet package. Yet, the reduced internal dimensions of the conical section 11 do not prohibit the lift pole 8 from being moved through the hollow plug 6 and into the inner tube 2.

It will be understood that the foregoing relates only to a preferred embodiment of the present invention, and that numerous changes and modifications may be made therein without departing from the spirit and scope of the invention as set forth in the following claims.

I claim:

1. An expandable core for insertion into the inner tube of rolled sheet material comprising:

a tubular open ended core body including cylindrical and conical sections which are intergral and coaxial, said cylindrical section having an outer end and a inner end, said conical section having a small diameter outer and a large diameter inner end larger than its outer end and of the same size as and integrally connected to the inner end of said cylindrical section, a series of approximately equally spaced elongated weakened areas formed along the length of said conical section for allowing the conical section to divide from its small diameter outer end toward its large diameter inner end along the elongated weakened areas into a plurality of spread apart fingers in response to outwardly directed forces applied to the conical section from within the conical section.

2. The expandable core of claim 1 and further including a plurality of approximately equally spaced elongated parallel external ribs formed along the outer surface of said cylindrical section for engaging the inner tube of the rolled sheet material, so that when the expandable core is inserted into the tube of the rolled sheet material the external ribs bear a major portion of the sliding friction between the expandable core and surfaces of the facing materials of the inner tube.

3. The expandable core of claim 2 and further including teeth formed on each of said external ribs, with each of said teeth sloped toward the outer end of said cylindrical section of said expandable core so as to engage the facing materials of said inner tube and resist removal of said expandable core from the inner tube.

4. The method of transporting reels of spiral rolled sheet material such as carpet wound about an inner tube comprising:

inserting an elongated shaft along its length, horizontally through an open ended core at one end of the inner tube of a reel of wound carpet and into the inner tube, as the elongated shaft is inserted through the open ended core, expanding an end portion of the core in response to the movement of the shaft through the core, lifting, transporting and lowering the elongated shaft with the reel of carpet supported on the shaft to transport the reel of carpet, withdrawing the elongated shaft along its length from the core and the inner tube, and as the elongated shaft is withdrawn from the core and the inner tube, resisting the withdrawal of the core from the inner tube by engaging with teeth of the core against the facing materials of the inner tube.

* * * * *